US010895001B2

(12) United States Patent
Nordgren et al.

(10) Patent No.: US 10,895,001 B2
(45) Date of Patent: Jan. 19, 2021

(54) ROCK DRILL BUTTON

(71) Applicant: SANDVIK INTELLECTUAL PROPERTY AB, Sandviken (SE)

(72) Inventors: Anders Nordgren, Enskede (SE); Anna Ekmarker, Ankarvsik (SE); Susanne Norgren, Huddinge (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/561,059

(22) PCT Filed: Mar. 23, 2016

(86) PCT No.: PCT/EP2016/056403
§ 371 (c)(1),
(2) Date: Sep. 24, 2017

(87) PCT Pub. No.: WO2016/151025
PCT Pub. Date: Sep. 29, 2016

(65) Prior Publication Data

US 2018/0073108 A1 Mar. 15, 2018

(30) Foreign Application Priority Data

Mar. 26, 2015 (EP) ..... 15160962

(51) Int. Cl.
*C22C 29/06* (2006.01)
*C22C 29/08* (2006.01)
(Continued)

(52) U.S. Cl.
CPC ..... *C22C 29/067* (2013.01); *C22C 29/08* (2013.01); *E21B 10/56* (2013.01); *B22F 2005/001* (2013.01)

(58) Field of Classification Search
None
See application file for complete search history.

(56) References Cited

U.S. PATENT DOCUMENTS 6,250,855 B1 * 6/2001 Persson ..... C22C 29/08 407/118
6,514,456 B1 2/2003 Lackner et al.
(Continued)

FOREIGN PATENT DOCUMENTS

CN 101318229 A 12/2008
EP 1803830 A1 7/2007
(Continued)

OTHER PUBLICATIONS

Hardness Conversion Chart 3. https://mdmetric.com/tech/hardnessconversion.html (Nov. 26, 2019).*
(Continued)

*Primary Examiner* — Pegah Parvini
*Assistant Examiner* — Ross J Christie
(74) *Attorney, Agent, or Firm* — Corinne R. Gorski

(57) ABSTRACT

A rock drill button having a body of sintered cemented carbide that has hard constituents of tungsten carbide (WC) in a binder phase of Co, wherein the cemented carbide has 4-12 mass % Co and balance WC and unavoidable impurities. The cemented carbide also has Cr in such an amount that the Cr/Co ratio is within the range of 0.043-0.19, and that the WC grain size mean value is above 1.75 μm.

13 Claims, 3 Drawing Sheets

(51) Int. Cl.
*E21B 10/56* (2006.01)
*B22F 5/00* (2006.01)

(56) References Cited

U.S. PATENT DOCUMENTS

| | | | | |
|---|---|---|---|---|
| 2002/0029910 | A1* | 3/2002 | Heinrich | C22C 29/005 175/394 |
| 2003/0175536 | A1* | 9/2003 | Penich | C23C 14/0641 428/469 |
| 2006/0093859 | A1 | 5/2006 | Konyashin et al. | |
| 2008/0166527 | A1* | 7/2008 | Lenander | C23C 30/005 428/194 |
| 2012/0144753 | A1 | 6/2012 | Okuno et al. | |
| 2014/0174633 | A1* | 6/2014 | Andersin | C04B 35/52 156/89.27 |
| 2014/0271321 | A1 | 9/2014 | Maderud et al. | |

FOREIGN PATENT DOCUMENTS

| | | | | |
|---|---|---|---|---|
| GB | 2270526 A | * | 3/1994 | C22C 29/08 |
| GB | 2270526 A | | 3/1994 | |
| JP | 2007030096 A | | 2/2007 | |
| JP | 5152770 B1 | | 2/2013 | |
| JP | 2013170285 A | | 9/2013 | |
| WO | WO-2012038428 A1 | * | 3/2012 | E21B 10/36 |

OTHER PUBLICATIONS

Hardness Conversion Calculator. Conversion of 92.6 Rockwell Hardness A to 1664 Vickers Hardness. https://www.tribology-abc.com/calculators/hardness.htm (Year: 2020).*

Hardness Conversion Calculator. Conversion of 93.4 Rockwell Hardness A to 1789 Vickers Hardness. https://www.tribology-abc.com/calculators/hardness.htm (Year: 2020).*

Database WPI Week 2013192013 Thomson Scientific, London, GB; AN 2013-D06632 XP002742763, & JP 5 152770 B1 (MTS Co Ltd) Feb. 27, 2013 abstract & JP 2013 170285 A (MTS KK; Notoalloy Co Ltd) Sep. 2, 2013 claim 1 paragraph [0004].

Database WPI Week 200721 2007 Thomson Scientific, London, GB; AN 2007-203447 XP002742764, & JP 2007 030096 A (Toshiba Tungaloy KK) Feb. 8, 2007 abstract paragraphs [0007], [0008].

Sun Yanzong et al. "Rock Drivage Engineering". Metallurgical Industry Press, p. 148. May 31, 2011.

* cited by examiner

FFP121

FFP256

FFP186

ROCK DRILL BUTTON

RELATED APPLICATION DATA

This application is a § 371 National Stage Application of PCT International Application No. PCT/EP2016/056403 filed Mar. 23, 2016 claiming priority to EP 15160962.5 filed Mar. 26, 2015.

TECHNICAL FIELD

The present invention relates to rock drill buttons, comprising a body made of sintered cemented carbide that comprises hard constituents of tungsten carbide (WC) in a binder phase comprising Co, wherein the cemented carbide comprises 4-12 mass % Co and balance WC and unavoidable impurities.

BACKGROUND OF THE INVENTION

Rock drilling is a technical area in which the buttons which are used for the purpose of drilling in the rock are subjected to both severe corrosive conditions and repeated impacts due to the inherent nature of the drilling. Different drilling techniques will result in different impact loads on the buttons. Particularly severe impact conditions are found in applications such as those in which the rock drill buttons are mounted in a rock drill bit body of a top-hammer (TH) device or a down-the-hole (DTH) drilling device. The conditions to which the rock drill buttons are subjected during rock drilling also require that the rock drill buttons have a predetermined thermal conductivity in order to prevent them from attaining too high temperature.

Traditionally, rock drill buttons may consist of a body made of sintered cemented carbide that comprises hard constituents of tungsten carbide (WC) in a binder phase comprising cobalt (Co).

The present invention aims at investigating the possibility of adding chromium to the further components of the sintered cemented carbide, before the compaction and sintering of said carbide, and also to investigate if such further addition will require any further modification of the sintered carbide in order to obtain a functional rock drill button made thereof.

In the technical area of cutting inserts for the cutting of metals, such as disclosed in, for example, EP 1803830, it has been suggested to include chromium in cutting inserts made of sintered cemented carbide comprising WC and cobalt for the purpose of reducing the grain growth of WC during the sintering process. Prevention of WC grain growth will promote the hardness and strength of the insert. However, cemented carbide having fine grained WC is not suitable for rock drilling since it is in general too brittle and has a lower thermal conductivity compared to coarse grained cemented carbide. Percussive rock drilling requires a cemented carbide which has a sufficient level of toughness. Chromium addition would be expected to, in addition to make the cemented carbide grain size smaller, also make the binder phase harder which would also reduce the overall toughness.

THE OBJECT OF THE INVENTION

It is an object of the present invention to present a rock drill button which is improved in comparison to rock drill buttons of prior art made of cemented carbide consisting of WC and Co in the sense that they have an improved corrosion resistance which reduces the wear in wet drilling conditions. Still the cemented carbide must have an acceptable hardness and ductility to withstand the repeated impact load that it will be subjected to during use. In other words, it must not be too brittle.

SUMMARY OF THE INVENTION

The object of the invention is achieved by means of a rock drill button, comprising a body made of sintered cemented carbide that comprises hard constituents of tungsten carbide (WC) in a binder phase comprising Co, wherein the cemented carbide comprises 4-12 mass % Co and balance WC and unavoidable impurities, characterized in that said cemented carbide also comprises Cr in such an amount that the Cr/Co ratio is within the range of 0.043-0.19, and that the WC grain size mean value is above 1.75 μm. In other words, the cemented carbide consists of 4-12 mass % Co, such an amount of Cr that relation between the mass percentage of Cr and the mass percentage of Co is in the range of 0.043-0.19, and balance WC and unavoidable impurities, wherein the WC grain size mean value is above 1.75 μm (as determined with the method described in the Examples section herein). According to one embodiment the WC grain size is above 1.8 μm, and according to yet another embodiment it is above 2.0 μm. Preferably, at least a major part of the rock drill button, and preferably an active part thereof aimed for engagement with the rock that is operated on, comprises cemented carbide that has the features defined hereinabove and/or hereinafter and which are essential to the present invention. According to one embodiment, the rock drill button comprises cemented carbide with the features defined hereinabove and/or hereinafter all through the body thereof. The rock drill button is produced by means of a process in which a powder comprising the elements of the cemented carbide is milled and compacted into a compact which is then sintered.

The addition of Cr results in an improvement of the corrosion resistance of the Co-binder phase, which reduces the wear in wet drilling conditions. The Cr also makes the binder phase prone to transform from fcc to hcp during drilling that will absorb some of the energy generated in the drilling operation. The transformation will thereby harden the binder phase and reduce the wear of the button during use thereof. If the Cr/Co ratio is too low, the mentioned positive effects of Cr will be too small. If, on the other hand, the Cr/Co ratio is too high, there will be a formation of chromium carbides in which cobalt is dissolved, whereby the amount of binder phase is reduced and the cemented carbide becomes too brittle. By having a WC grain size mean value above 1.75 μm, or above 1.8 μm or above 2.0 μm, a sufficient thermal conductivity and non-brittleness of the cemented carbide is achieved. If the WC grain size is too large, the material becomes difficult to sinter. Therefore, it is preferred that the WC grain size mean value is less than 15 μm, preferably less than 10 μm.

According to a preferred embodiment, the Cr/Co ratio is equal to or above 0.075.

According to yet a preferred embodiment, the Cr/Co ratio is equal to or above 0.085.

According to another preferred embodiment, the Cr/Co ratio is equal to or less than 0.15.

According to yet another preferred embodiment, the Cr/Co ratio is equal to or less than 0.12.

Preferably, the content of Cr in said cemented carbide is equal to or above 0.17 mass %, preferably equal to or above 0.4 mass %.

According to yet another embodiment, the content of Cr in said cemented carbide is equal to or lower than 2.3 mass %, preferably equal to or lower than 1.2 mass %. The cobalt, forming the binder phase, should suitably be able to dissolving all the chromium present in the sintered cemented carbide at 1000° C.

Up to less than 3 mass %, preferably up to less than 2 mass % chromium carbides may be allowed in the cemented carbide. However, preferably, the Cr is present in the binder phase as dissolved in cobalt. Preferably, all chromium is dissolved in cobalt, and the sintered cemented carbide is essentially free from chromium carbides. Preferably, to avoid the upcoming of such chromium carbides, the Cr/Co ratio should be low enough to guarantee that the maximum content of chromium does not exceed the solubility limit of chromium in cobalt at 1000° C. Preferably, the sintered cemented carbide is free from any graphite and is also free from any η-phase. In order to avoid the generation of chromium carbide or graphite in the binder phase, the amount of added carbon should be at a sufficiently low level.

The rock drill button of the invention must not be prone to failure due to brittleness-related problems. Therefore, the cemented carbide of the rock drill button according to the invention has a hardness of not higher than 1500 HV3.

According to one embodiment, rock drill buttons according to the invention are mounted in a rock drill bit body of a top-hammer (TH) device or a down-the-hole (DTH) drilling device. The invention also relates to a rock drill device, in particular a top-hammer device, or a down-the-hole drilling device, as well as the use of a rock drill button according to the invention in such a device.

According to yet another embodiment, $M_7C_3$ is present in the cemented carbide. In this case M is a combination of Cr, Co and W, i.e., $(Cr,Co,W)_7C_3$. The Co solubility could reach as high as 38 at % of the metallic content in the $M_7C_3$ carbide. The exact balance of Cr:Co:W is determined by the overall carbon content of the cemented carbide. The ratio $Cr/M_7C_3$ (Cr as weight % and $M_7C_3$ as vol %) in the cemented carbide is suitably equal to or above 0.05, or equal to or above 0.1, or equal to or above 0.2, or equal to or above 0.3, or equal to or above 0.4. The ratio $Cr/M_7C_3$ (Cr as weight % and $M_7C_3$ as vol %) in the cemented carbide is suitably equal to or less than 0.5, or equal to or less than 0.4. The content of $M_7C_3$ is defined as vol % since that is how it is practically measured. Expected negative effects in rock drilling by the presence of $M_7C_3$ cannot surprisingly be seen. Such negative effects in rock drilling would have been brittleness of the cemented carbide due to the additional carbide and also reduced toughness due to the lowering of binder phase (Co) content when $M_7C_3$ is formed. Thus, the acceptable range for carbon content during production of cemented carbide can be wider since $M_7C_3$ can be accepted. This a great production advantage.

BRIEF DESCRIPTION OF THE DRAWINGS

Examples will be presented with reference to the annexed drawings, on which.

EXAMPLES

Example 1

Reference

Figure 1A:
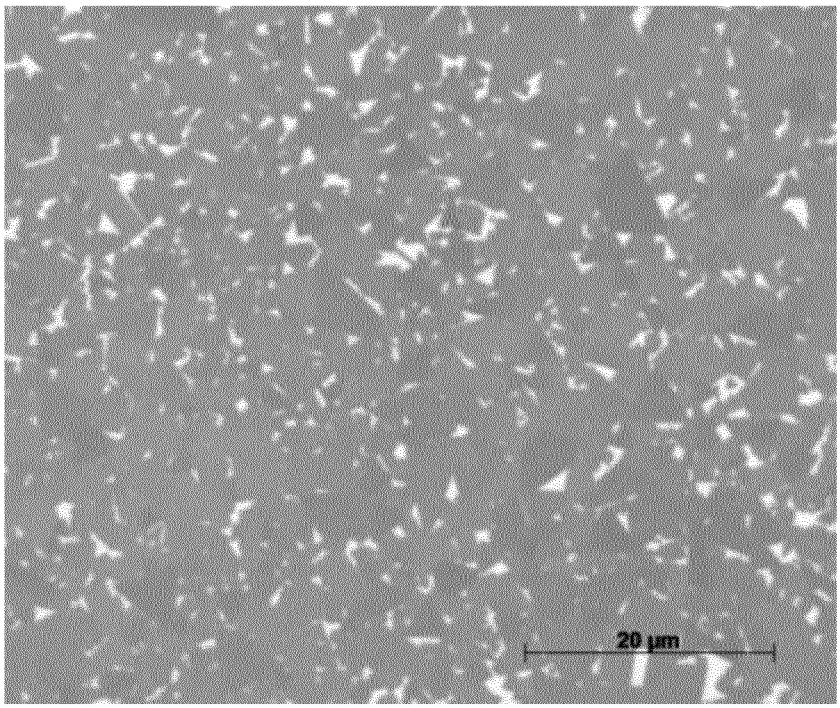
FIG. 1*a*-1*c* show sintered structure of test sample materials denoted FFP121, FFP256 and FFP186, by means of light optical images of sample cross sections polished with conventional cemented carbide methods, wherein final polishing was done with 1 μm diamond paste on a soft cloth.

A material with 6.0 wt % Co and balance WC was made according to established cemented carbide processes. Powders of 26.1 kg WC, 1.72 kg Co and 208 g W were milled in a ball mill for in total 11.5 hours. During milling, 16.8 g C was added to reach the desired carbon content. The milling was carried out in wet conditions, using ethanol, with an addition of 2 wt % polyethylene glycol (PEG 80) as organic binder and 120 kg WC-Co cylpebs in a 30 litre mill. After milling, the slurry was spray-dried in $N_2$-atmosphere. Green bodies were produced by uniaxial pressing and sintered by using Sinter-HIP in 55 bar Argon-pressure at 1410° C. for 1 hour.

Details on the sintered material are shown in table 1.

The WC grain size measured as FSSS was before milling 5.6 μm.

Example 2

Invention

A material with 6.0 wt % Co, 0.6 wt % Cr and balance WC was made according to established cemented carbide processes. Powders of 25.7 kg WC, 1.72 kg Co 195 g $Cr_3C_2$ and 380 g W were milled in a ball mill for in total 13.5 hours. During milling, 28.0 g C was added to reach the desired carbon content. The milling was carried out in wet conditions, using ethanol, with an addition of 2 wt % polyethylene glycol (PEG 80) as organic binder and 120 kg WC-Co cylpebs in a 30 litre mill. After milling, the slurry was spray-dried in $N_2$-atmosphere. Green bodies were produced by uniaxial pressing and sintered by using Sinter-HIP in 55 bar Ar-pressure at 1410° C. for 1 hour.

The composition after sintering is given in Table 1, denoted FFP121, and sintered structure is shown in FIG. 1*a*. The material is essentially free from chromium carbide precipitations.

The WC grain size measured as FSSS was before milling 6.25 μm.

TABLE 1

Details on materials produced according to example 1-3.

| | Material | | |
|---|---|---|---|
| | FFP122 | FFP121 | FFP256 |
| Co (wt %) | 6.09 | 6.17 | nm |
| Cr (wt %) | — | 0.59 | nm |
| C (wt %) | 5.71 | 5.77 | nm |
| W (wt %) | 88.2 | 87.5 | nm |
| Hc (kA/m) | 9.9 | 9.8 | 6.9 |
| Magnetic saturation ($T * m^3/kg$) | $112 * 10^{-7}$ | $99 * 10^{-7}$ | $152 * 10^{-7}$ |

TABLE 1-continued

Details on materials produced according to example 1-3.

| | Material | | |
|---|---|---|---|
| | FFP122 | FFP121 | FFP256 |
| Density (g/cm3) | 14.98 | 14.83 | 14.27 |
| Porosity | A00B00C00 | A00B00C00 | A00B00C00 |
| Hv3 | 1402 | 1393 | 1157 |
| K1c* | 12.4 | 11.2 | nm |

*Palmqvist fracture toughness according to ISO/DIS 28079

Example 3

Invention

A material with 11.0 wt % Co, 1.1 wt % Cr and balance WC was made according to established cemented carbide processes. Powders of 37.7 kg WC, 3.15 kg Co, 358 g $Cr_3C_2$ and 863 g W were milled in a ball mill for in total 9 hours. During milling, 19.6 g C was added to reach the desired carbon content. The milling was carried out in wet conditions, using ethanol, with an addition of 2 wt % polyethylene glycol (PEG 40) as organic binder and 120 kg WC-Co cylpebs in a 30 litre mill. After milling, the slurry was spray-dried in $N_2$-atmosphere. Green bodies were produced by uniaxial pressing and sintered by using Sinter-HIP in 55 bar Ar-pressure at 1410° C. for 1 hour.

Figure 1B:
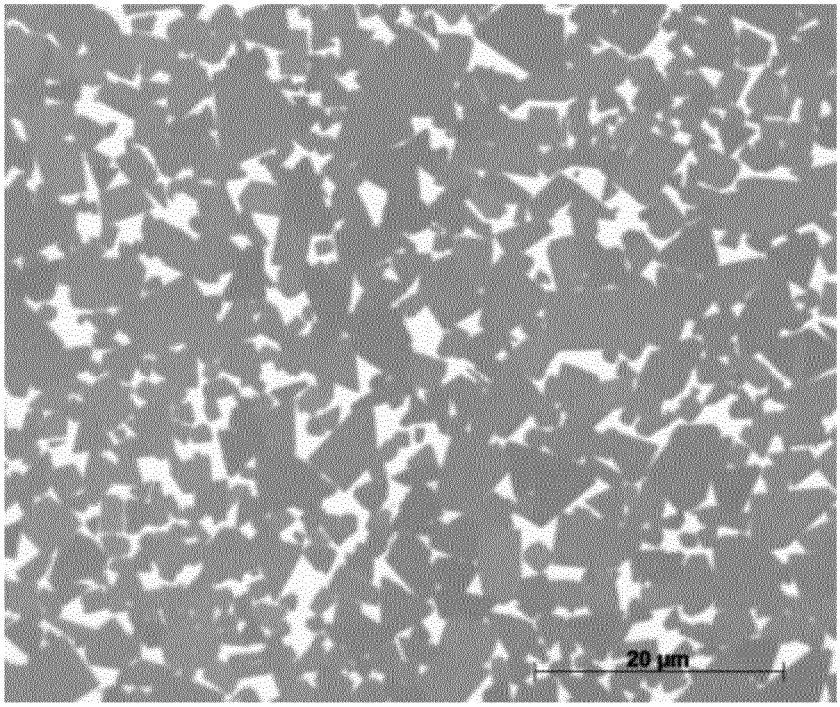

Details on the sintered material are given in table 1 and the structure is shown in FIG. 1*b*, denoted FFP256. The material is essentially free from chromium carbide precipitations.

The WC grain size measured as FSSS was before milling 15.0 μm.

WC Grain Sizes of Sintered Samples of Examples 1-3

The WC grain size of the sintered materials FFP121, FFP122 and FFP256 (examples 1-3) were determined from SEM micrographs showing representative cross sections of the materials. Final step of the sample preparation was done by polishing with 1 μm diamond paste on a soft cloth followed by etching with Murakami SEM micrographs were taken in the backscatter electron mode, magnification 2000×, high voltage 15 kV and working distance ~10 mm.

The total area of the image surface is measured and the number of grains is manually counted. To eliminate the effect of half grains cut by the micrograph frame, all grains along two sides are included in the analysis, and grains on the two opposite sides are totally excluded from the analysis. The average grain size is calculated by multiplying the total image area with approximated volume fraction of WC and divide with the number of grains. Equivalent circle diameters (i.e. the diameter of a circle with area equivalent to the average grain size) are calculated. It should be noted that reported grain diameters are valid for random two dimensional cross sections of the grains, and is not a true diameter of the three dimensional grain. Table 2 shows the result.

TABLE 2

| Sample material | WC grain size (Equivalent circle diameter) |
|---|---|
| FFP122 (According to example 1) | 1.8 μm |
| FFP121 (According to example 2) | 2.1 μm |
| FFP256 (According to example 3) | 2.5 μm |

Example 4

Outside Invention

A material with 11.0 wt % Co, 1.1 wt % Cr and balance WC was made according to established cemented carbide processes. Powders of 87.8 g WC, 11.3 g Co, 1.28 g $Cr_3C_2$ and 0.14 g C were milled in a ball mill for 8 hours. The milling was carried out in wet conditions, using ethanol, with an addition of 2 wt % polyethylene glycol (PEG 40) as organic binder and 800 g WC-Co cylpebs. After milling, the slurry was pan dried and blanks were produced by uniaxial pressing and sintered by using Sinter-HIP in 55 bar Ar-pressure at 1410° C. for 1 hour.

Figure 1C:
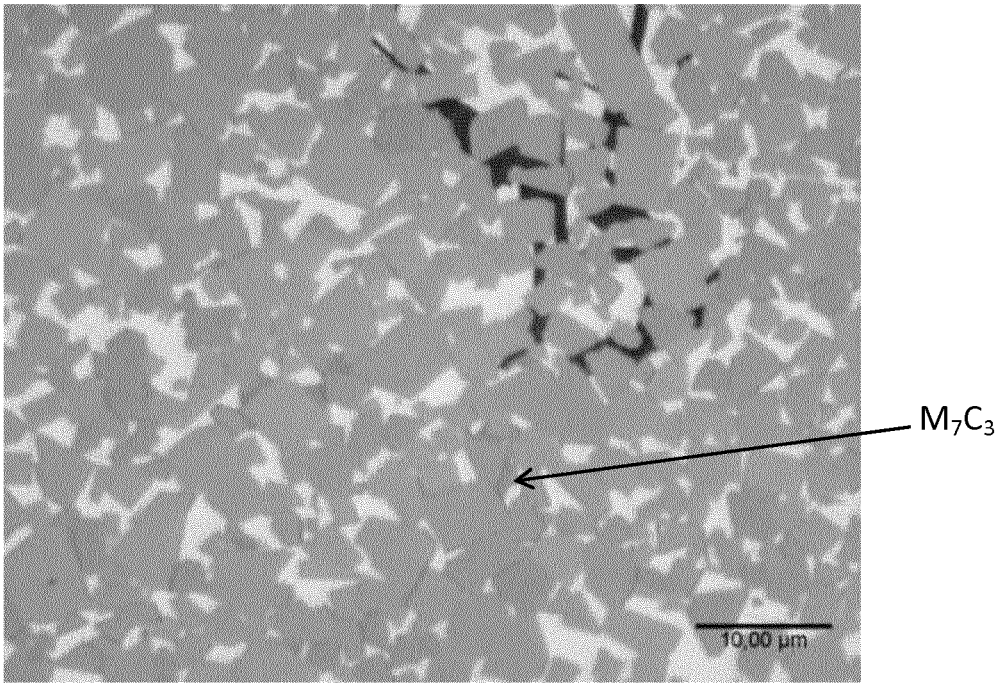

The sintered structure is shown in FIG. 1*c*, denoted FFP186. The sintered material has both chromium carbide and graphite precipitations due to excessive amount of added carbon and is thus outside the invention. According to the invention, chromium carbide precipitations could possibly be allowed provided that the content is less than 3 wt %, preferably less than 2 wt %. However, graphite precipitations are not allowed.

The WC grain size measured as FSSS was before milling 15.0 μm.

Example 5

Drill bit inserts (rock drill buttons) were pressed and sintered according to the description in example 1 and example 2 respectively. The inserts were tumbled according to standard procedures known in the art and thereafter mounted into a Ø48 mm drill bit with 3 front inserts (Ø9 mm, spherical front) and 9 gage inserts (Ø10 mm, spherical front). The carbide bits were mounted by heating the steel bit and inserting the carbide inserts.

The bits were tested in a mine in northern Sweden. The test rig was an Atlas Copco twin boom Jumbo© equipped with AC2238 or AC3038 hammers. Drilling was done with one bit according to example 2 (invention, denoted FFP121) and one reference bit according to example 1 (reference, denoted FFP122) at the same time, one on each boom. After drilling roughly 20-25 meters (~4-5 drill holes) with each bit, the bits were switched between left and right boom to minimize the effect of varying rock conditions, and ~20-25 more meters were drilled with each bit. Then the bits were reground to regain spherical fronts, before drilling again. The bits were drilled until end of life due to too small diameter (<45.5 mm).

Bit diameter wear was the main measure of carbide performance. The bit diameter was measured both before and after drilling (before grinding), all three diameters between opposed gage buttons, were measured and the largest of these three values was reported as bit diameter.

Test results show that carbide according to the invention suffered from less wear than the reference material, see Table 3. FFP121 bits drilled by average 576 meters per bit compared to 449 drill meters for the reference FFP122.

Figure 2:
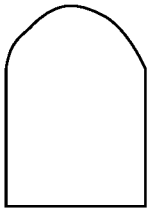
FIG. 2 is a schematic representation of the geometry of a rock drill button used in testing.

The total diameter wear during all drilling with each bit is shown in FIG. 2. It should be noted that the diameter decrease due to grinding losses is not included. The reference material FFP122 was worn 0.0055 mm per drill meter while the invention FFP121 was worn only 0.0035 mm per drill meter. The numbers are inverted to obtain drilled length per mm bit wear; the reference has drilled ~183 drill meters per mm bit wear, and the invention has done ~286 drill meters per mm bit wear.

TABLE 3

Field test results of all tested bits.

| Bits with reference carbide according to example 1 (FFP122) | | | | Bits with carbide according to invention example 2 (FFP121) | | | |
|---|---|---|---|---|---|---|---|
| Bit no. | Total drill meters (m) | Total bit diameter wear during drilling (mm) | Total bit diameter wear during drilling and grinding (mm) | Bit no. | Total drill meters (m) | Total bit diameter wear during drilling (mm) | Total bit diameter wear during drilling and grinding (mm) |
| 1 | 507 | 2.27 | 4.43 | 21 | 598.5 | 1.99 | 4.09 |
| 2 | 462 | 2.36 | 3.91 | 22 | 325* | 0.81 | 1.91 |
| 3 | 470 | 2.32 | 3.94 | 23 | 721.1 | 1.62 | 3.98 |
| 4 | 450.5 | 2.16 | 3.97 | 24 | 525.7 | 1.76 | 3.99 |
| 5 | 374.5 | 2.89 | 4.28 | 25 | 508.7 | 1.82 | 3.78 |
| 6 | 332 | 2.32 | 3.9 | 26 | 561.2 | 2.09 | 3.96 |
| 7 | 450.6 | 2.31 | 4.06 | 27 | 536.8 | 1.94 | 4.05 |
| 8 | 497.4 | 3.16 | 4.72 | 28 | 583.1 | 1.85 | 4.0 |
| 9 | 437.1 | 2.42 | 3.89 | 29 | 574.2 | 2.66 | 4.0 |
| 10 | 513.7 | 2.66 | 3.98 | 30 | 578.7 | 2.69 | 4.24 |

*Bit no 22 was lost due to a rod breakage and are thus excluded when calculating the average drill meters per bit.

FIG. 2. Bit diameter change during drilling.

Example 6

Test solid rods according to reference example 1 denoted FFP122 and invention example 2, denoted FFP121 were prepared, with the exception that in this example the green bodies were pressed in a dry-bag press. The rods were manufactured to test the high temperature compressive creep strength of the reference, ex 1 and the invention, ex 2.

The temperature during testing was 1000° C. and the stress was 900 MPa. The following results were noted (see Table 4):

TABLE 4

| Deformation | Time needed (Sec) | |
|---|---|---|
| (%) | Ref (FFP122) | Invention (FFP121) |
| 10% | 850 | 2320 |
| 20% | 1320 | 3220 |

Totally 4 test pieces for each material were tested, two with 10% deformation and two with 20% deformation. Argon was used as protective gas.

Figure 3:
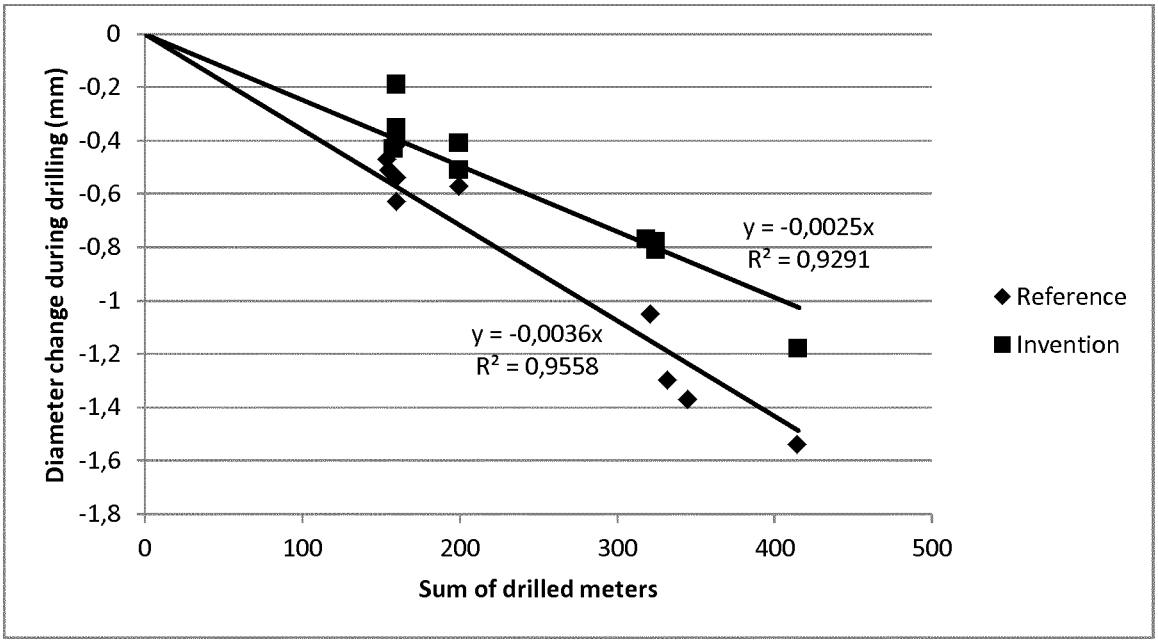
FIG. 3 is a diagram showing bit diameter change during drilling for reference example 1 denoted FFP122 and invention example 2, denoted FFP121.
Figure 4:
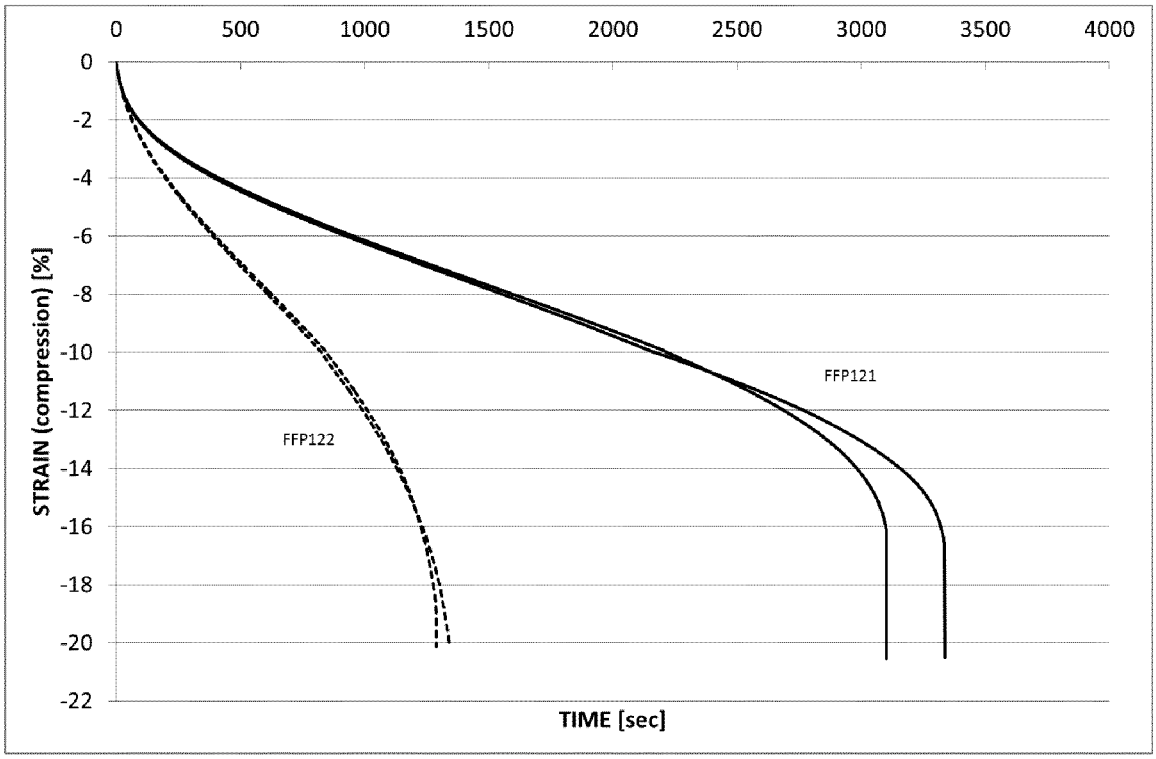
FIG. 4 shows creep curves for reference example 1 denoted FFP122 and invention example 2, denoted FFP121 (applied stress 900 MPa, temperature 1000C).

The results are shown in FIG. 3. The drill bit inserts according to the invention presented better performance than the drill bit inserts according to prior art.

Example 7

Abrasion Wear Testing

Rock drill bit inserts (010 mm, spherical front) according to example 1 and 2 have been tested in an abrasion wear test where the sample tips are worn against a rotating granite log counter surface in a turning operation. In the test the load applied to each insert was 200 N, the rotational speed was 270 rpm and the horizontal feed rate was 0.339 mm/rev. The sliding distance in each test was fixed to 230 m and the sample was cooled by a continuous flow of water. Three samples per material were evaluated and each sample was carefully weighed prior and after the test. Sample volume loss was calculated from measured mass loss and sample density and serves as a measurement of wear.

The abrasion wear test clearly shows a significantly increased wear resistance for the material according to the invention (FFP121) compared to the reference material FFP122, see results in Table 5.

TABLE 5

Results as sample wear measured in the abrasion wear test.

| Sample material | Volumetric wear of each specimen (mm3) | Average volumetric wear (mm3) | Standard deviation volumetric wear (mm3) |
|---|---|---|---|
| FFP122 | 0.28 | 0.28 | 0.01 |
| (According to | 0.27 | | |
| example 1) | 0.29 | | |
| FFP121 | 0.17 | 0.19 | 0.02 |
| (According to | 0.20 | | |
| example 2) | 0.20 | | |

The invention claimed is:

1. A rock drill button, consisting of:

a body having an active part at a tip portion arranged to engage a rock to be drilled, the active part being made of sintered cemented carbide that consists of hard constituents of tungsten carbide (WC) in a binder phase comprising Co, wherein the cemented carbide comprises 4-12 mass % Co, Cr and a balance of WC and unavoidable impurities, and wherein said cemented carbide comprises Cr in such an amount that the Cr/Co ratio is within the range of 0.043-0.19, and wherein a WC grain size mean value is above 1.75 μm.

2. The rock drill button according to claim 1, wherein the WC grain size mean value is above 2.0 μm.

3. The rock drill button according to claim 1, wherein the Cr/Co ratio is equal to or above 0.075.

4. The rock drill button according to claim 1, wherein the Cr/Co ratio is equal to or above 0.085.

5. The rock drill button according to claim 1, wherein the Cr/Co ratio is equal to or less than 0.15.

6. The rock drill button according to claim 1, wherein the Cr/Co ratio is equal to or less than 0.12.

7. The rock drill button according to claim 1, wherein the content of Cr in said cemented carbide is equal to or above 0.17 mass %.

8. The rock drill button according to claim 1, wherein the content of Cr in said cemented carbide is equal to or lower than 2.3 mass %.

9. The rock drill button according to claim 1, wherein the Cr is present in the binder phase as dissolved in cobalt.

10. The rock drill button according to claim 1, wherein the binder phase is essentially free from chromium carbide.

11. The rock drill button according to claim 1, wherein said cemented carbide has a hardness of not higher than 1500 HV3.

12. The rock drill button according to claim 1, wherein the content of Cr in said cemented carbide is equal to or above 0.4 mass %.

13. The rock drill button according to claim 1, wherein the content of Cr in said cemented carbide is equal to or lower than 1.2 mass %.

* * * * *